United States Patent [19]

Holt et al.

[11] 3,970,855

[45] July 20, 1976

[54] POSITRON PROBES FOR MECHANICAL FATIGUE DETECTION SYSTEM

[75] Inventors: William H. Holt; Willis Mock, Jr., both of Fredericksburg, Va.

[73] Assignee: The United States of America as represented by the Secretary of the Navy, Washington, D.C.

[22] Filed: May 23, 1975

[21] Appl. No.: 580,447

[52] U.S. Cl. ..... 250/493; 250/358 R

[51] Int. Cl.[2] ..... G21G 4/00

[58] Field of Search ..... 250/493, 496, 506, 358, 250/306, 308, 393, 395, 396, 397

[56] References Cited

UNITED STATES PATENTS

| | | | |
|---|---|---|---|
| 3,588,507 | 6/1971 | Weinstock et al. | 250/308 |
| 3,675,021 | 7/1972 | Aladjem | 250/493 |
| 3,859,179 | 1/1975 | Staples | 250/493 X |

*Primary Examiner*—Davis L. Willis

*Attorney, Agent, or Firm*—R. Sciascia; R. Beers; S. Sheinbein

[57] ABSTRACT

Positron-emitting probes that have certain features that facilitate the use of positrons for nondestructive testing of fatigued metals. The features include the use of an unfatigued substrate for supporting the positron-emitting material, electric and/or magnetic fields to concentrate the positrons on the test item, and a thin scintillator window for use with those radioactive materials that emit a positron without emitting a time-correlated gamma photon.

It should be understood that the foregoing abstract of the disclosure is for the purpose of providing a non-legal brief statement to serve as a searching-scanning tool for scientists, engineers and researchers and is not intended to limit the scope of the invention as disclosed herein nor is it intended that it should be used in interpreting or in any way limiting the scope of fair meaning of the appended claims.

9 Claims, 5 Drawing Figures

POSITRON LIFETIME SPECTRA —
5052-H32 ALUMINUM ALLOY oooo UNFATIGUED MATERIAL
..... AFTER FATIGUE CYCLING
COUNTS
$10^4$
$10^3$
$10^2$
100
150
CHANNELS (TIME)

POSITRON PROBES FOR MECHANICAL FATIGUE DETECTION SYSTEM

BACKGROUND OF THE INVENTION

This invention relates to positron annihilation techniques for studying defects in metals and especially to positron probes for use in the application of these techniques to nondestructive testing.

There is a continuing need for new techniques for the nondestructive testing and evaluation of mechanical components for both military and civilian use. Materials that must withstand severe mechanical and/or thermal stress cycling are subject to fatigue damage. In many cases, such as in aircraft parts or gun barrels, fatique failure can be catastrophic.

Conventional nondestructive testing methods, such as X-ray, electrical resistance, magnetic perturbation, ultrasonic, and holographic measurements, are not sensitive enough to detect fatigue damage until after small cracks have opened, which can be long after reasonable safety margins have been exceeded. X-ray techniques require precision geometric relationships to be maintained between the material being studied and the X-ray source and/or detector. Ultrasonic and acoustic holographic techniques may require the item being studied to be immersed in a suitable energy coupling medium such as water.

The need for reliable fatigue-life predictions and determinations for large-bore gun barrels will become increasingly important as chemical milling techniques allow the use of very wear-resistant brittle alloys for gun barrel fabrication. Fatigue life will become more important than wear life. If a technique were available for the periodic in situ monitoring of the extent of fatigue damage in a gun barrel, the very expensive replacement of these items could be scheduled in accordance with actual damage measurements, and the full safe fatigue life of a barrel could be utilized.

The use of positron annihilation techniques for research studies of defects in metals is well established. (For excellent review articles, see "Positron Annihilation Techniques, PAT, in Polymer Science and Engineering," Journal of Macromolecular Science-Reviews of Macromolecular Chemistry, Volume C9(2), pages 305–337, 1973, by Hameleck, Eldrup, Mogensen and Jansen, and, "Studies of Lattice Defects by Means Of Positron Annihilation", in Crystal Lattice Defects, Volume 4, pages 139–163, 1973, by Doyama and Hasiguti). Successful fatigue damage studies have been performed under laboratory conditions on specially prepared samples. However, the development of positron techniques for in situ fatigue damage measurements on highly stressed structures will depend in part on the development of suitable positron source probes. These probes would permit fatigue detection measurements to be performed on mechanical parts such as turbine blades, aircraft landing gears, helicopter rotor hubs, gun barrels and mounts.

An object of this invention is to fill the need for positron probes to be used in positron annihilation techniques for nondestructive testing applications.

SUMMARY OF THE INVENTION

The invention comprises positron-emitting probes for use in testing samples of metals for fatigue by positron annihilation techniques comprising a substrate made from the same material as the test sample, positron-emitting material supported by one surface of said substrate, and a cover for the emitting material, the cover being sealed to the substrate and being of such thinness and density as to provide a window through which positron passage is unimpeded.

Other objects, advantages and novel features of the present invention will become apparent from the following detailed description of the invention when considered in conjunction with the accompanying drawing.

DETAILED DESCRIPTION OF THE INVENTION

Figure 1:
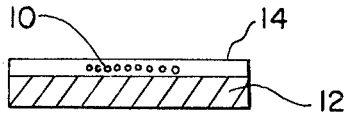
FIG. 1 is a schematic illustration of a basic embodiment of the invention.

An embodiment of an unfatigued substrate positron probe is shown in FIG. 1. Positron-emitting radioactive material 10, such as sodium 22 chloride, or cobalt 58, for example, is placed on a substrate 12 and covered with a thin cover 14 which acts as a window for the emitted positrons. The window 14 is any low-density material which can act as a seal for the radioactive material 10 and yet will not significantly impede the passage of the positrons. A thin layer of vacuum-deposited metal or a thin layer of polymer film may be employed. The substrate 12 is fabricated from the same material on which fatigue studies are to be made, and the substrate material is in the "as received" (unfatigued) condition.

In use, the probe is placed against the material on which the fatigue studies are to be made with the material abutting the upper surface of the window 14. When a positron is emitted from the radioactive material, a nuclear gamma ray (NGR) is emitted at approximately the same time. A pair of scintillation detectors (not shown) are used, one of which records the emission of the NGR. A second scintillation detector records the emission of the gamma ray produced by the annihilation of the positron when it collides with an electron in the substrate 12 or in the fatigued material. The latter will be called the annihilation gamma ray (AGR). The two types of gamma ray can be identified because they have different energy levels.

Figure 5:
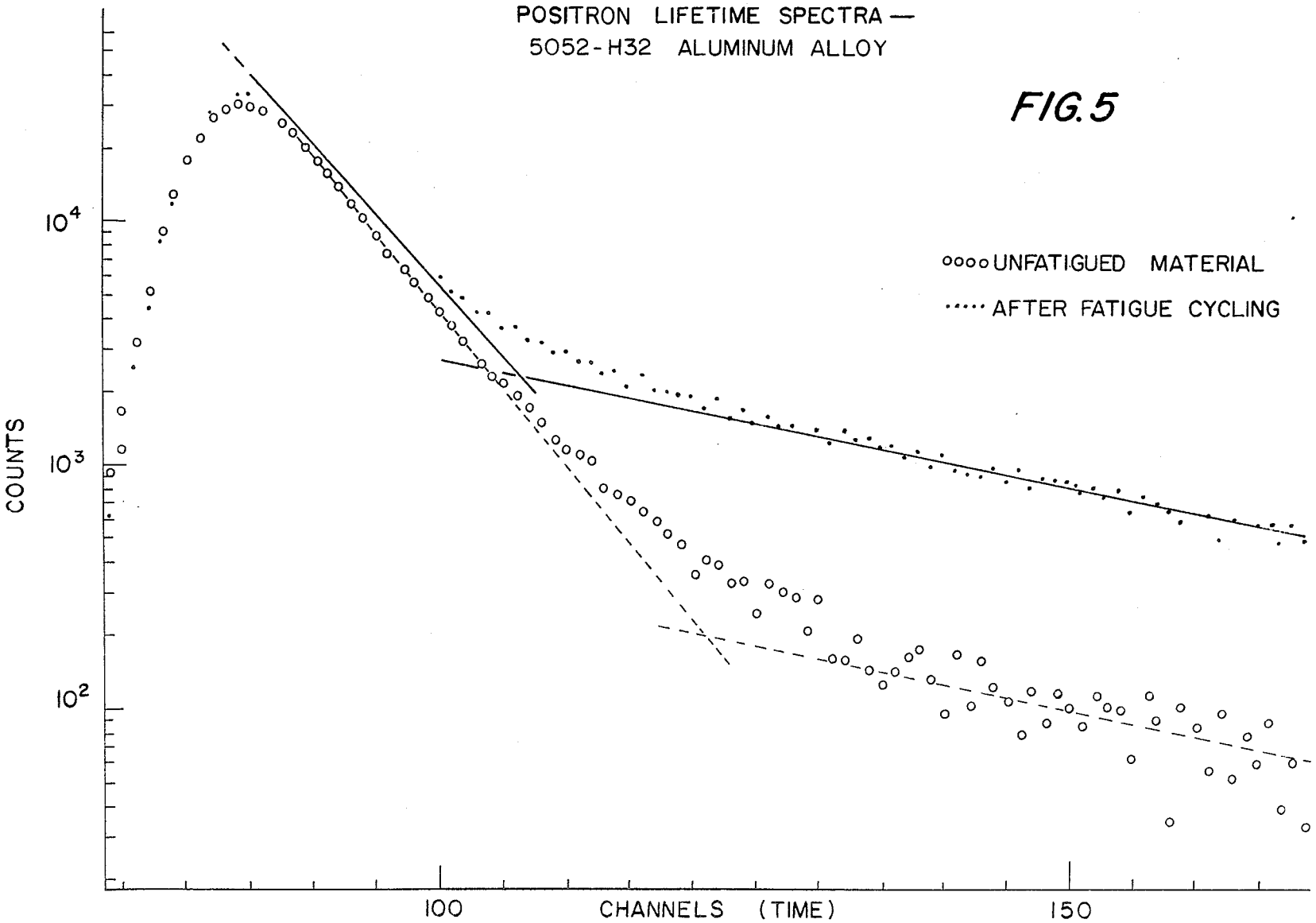
FIG. 5 is a graph showing positron lifetime spectra for an aluminum alloy.

Electronic circuits are used to determine the lifetimes of positrons which pass into the substrate of unfatigued material and the sample, or object, of fatigued material. A positron lifetime spectrum (FIG. 5) is then prepared. It will be noted that there is a separation (difference in shape) between the curves for the fatigued and unfatigued materials. Positron lifetime curves are obtained with a set of reference samples of the same material as that to be tested, each having a different but known amount of fatigue damage, thereby yielding different curves. These curves are used by the tester to determine, by comparison, the extent of fatigue damage in the material tested. The curve obtained in a test is then the sum of data derived from annihilations in the "as received" substrate material and in the material being tested. The advantage of having the same substrate and test materials is that the reference curve for the unfatigued state (using a reference sample of "as received" material) is not an admixture of data from different materials.

In the electric-field positron probe (see FIG. 2), the positron-emitting material 10 is sealed between an electrically conductive window 14 and an electrically conductive thin substrate 12. These are located internally of a electrically conductive ring 16 which is grounded, so that the window and thin substrate are also at ground potential. A high-voltage electrode 18 is placed above and spaced from the substrate 12 and the grounding ring, or housing, 16. A high-voltage lead 20 is brought in through insulation (the lead insulation) 22 to the high-voltage electrode 18. A high-voltage insulator 24 supports the high-voltage electrode and lead and spaces the lead and its insulation from the grounded housing.

The high-voltage insulator 24, which is ring-shaped in this embodiment, and the window 14 seal off the central cavity 26 of the housing 16, which is evacuated.

The high-voltage electrode 18 and the grounded substrate 12 form an electric field between them, when the high voltage is applied, which forces positrons emitted toward the electrode 18 downward through the window 14. The effect is to increase the number of positrons in the downward direction (hence, into test samples), thereby reducing the time involved for making a fatigue measurement. A fatigued object is placed in contact with the window and its curve is compared with those for the set of reference fatigue samples of the same material as that being tested.

Figure 3:
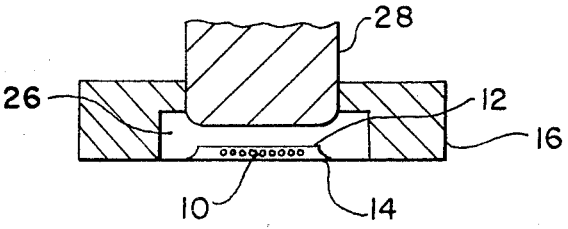
FIG. 3 is a schematic illustration of a positron probe which uses a magnetic field for positron direction.

The magnetic-field positron probe in FIG. 3 utilizes a magnetic field to collimate positrons onto the sample. A magnet 28 (permanent or electro-magnet) is spaced from the substrate 12. The upper part of the housing, or supporting ring, 16 abuts and is sealed to the magnet 28. The window 14 and substrate 12 are of nonmagnetic materials, such as polymer film and aluminum, respectively. Those emitted positrons that have momentum components perpendicular to the magnetic field lines are constrained to move along helical trajectories about the magnetic field lines. The magnetic-field probe is especially suited to non-contact applications (e.g. moving parts, where a space is maintained between the probe window and the tested item). When the area to be tested is comparable to or smaller than the size of the probe, the downward-directed but divergent positrons which would not otherwise intercept this area are redirected by the magnetic field onto the test area.

Figure 4:
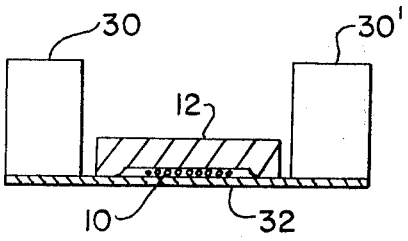
FIG. 4 is a schematic illustration of a scintillator-type positron probe.

The thin scintillator positron probe shown in FIG. 4 may be used for those radioactive materials 10 which emit positrons but not NGR's with the positrons. This embodiment uses a thin scintillator sheet 32 as a window and as a photon, or light, producer. A pair of photon detectors 30 and 30' are placed at the ends of the scintillator sheet 32. The photon detectors may be photomultipliers, for example, and the assemblage may be ring-shaped, if desired. That is, the scintillator sheet may be a circular disc with photomultipliers placed in a ring around its peripheral area and the substrate 12 may be circular when viewed from above.

The substrate is made of a gamma-ray-attenuating material, such as lead, so that gamma rays generated by positron annihilations do not reach the photon detectors. The test sample is placed in contact with the bottom surface of the sheet 32.

A positron which passes through the thin scintillator sheet produces light-photons which are detected to establish the time of emission of the positrons. This detection signifies the injection of a positron into the test item.

The scintillator sheet material may, for example, be a material comprising a plastic matrix of polyvinyltoluene in which there is p-terphenyl and *p, p'*-diphenyl stilbene, known by the trade name of "Pilot B."

Figure 2:
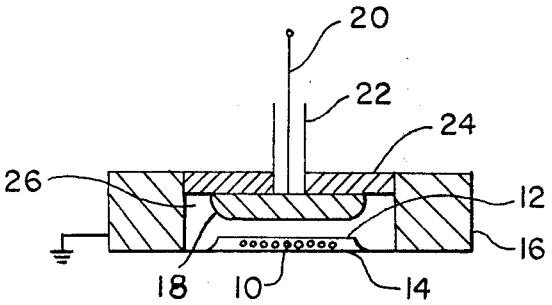
FIG. 2 is a schematic illustration of a positron probe which uses an electric field for positron direction.

A fifth embodiment of the invention (not shown in the drawing) may include both the electric field of the embodiment of FIG. 2 and the magnetic field of the embodiment of FIG. 3.

Obviously, many modifications and variations of the present invention are possible in light of the above teachings. It is therefore to be understood that, within the scope of the appended claims, the invention may be practiced otherwise than as specifically described.

What is claimed is:

1. A positron-emitting probe for use in testing samples of metals for defects by positron annihilation techniques comprising:

a substrate made from the same material as the test sample;

positron-emitting material supported by one surface of said substrate; and a cover for said material, said cover being sealed to said substrate to keep said material in place, said cover being of such thinness and density as to provide a window through which positron passage is uninhibited.

2. A probe as in claim 1, wherein said cover and substrate are electrically conductive, said probe further including:

a grounded support having a central hollow therein, the substrate-cover structure being located in said hollow and sealed hermetically at its edges to said support;

an electrical insulator located within said hollow and being hermetically sealed at its edges to said support, the insulator being spaced from said substrate and forming a hermetically sealed space therebetween, said space being evacuated; and an electrode for connection to a source of electrical potential, said electrode extending into said hermetically sealed space so that an electric field is produced between the electrode and the substrate upon application of an electrical potential difference between said electrode and said substrate.

3. A probe as in claim 1, further including:

a support having a central hollow therein, the substrate-cover structure being located in said hollow and sealed hermetically at its edges to said support; and a magnet, one pole of which extends into said hollow and is spaced from said substrate, said magnet being hermetically sealed to said support wherein a space is formed within said hollow bounded by said magnet, said support and said substrate, said space being evacuated.

4. A probe as in claim 1, further including:

a sheet of scintillator material said sheet being placed in contact with said cover and extending beyond the substrate-cover structure; and at least one photon detector located on the contacting surface of said scintillator sheet beyond said substrate-cover structure.

5. A probe as in claim 4, wherein said substrate is sufficiently thick to prevent passage of positrons through the substrate.

6. A positron-emitting probe designated as the "unfatigued substrate positron probe" for use in testing metal samples or objects for fatigue by positron lifetime techniques comprising:

a substrate made of the same material as that to be tested but in the unfatigued condition, said substrate being of such thickness as to absorb all those positrons that enter it;

positron-emitting material supported by one surface of said substrate; and a cover for said material, said cover being sealed to said substrate to keep said material in place, said cover being of such thinness and density as to provide a window through which positron passage is uninhibited, said probe to be used with a set of reference fatigue samples of the same material as that to be tested, each having a different but known amount of fatigue damage.

7. A positron-emitting probe designated as the "electric-field positron probe" for use in testing metal samples or objects for fatigue by positron lifetime techniques comprising:

an electrically conductive thin substrate;

positron-emitting material supported by one side of said substrate;

a thin window covering said positron-emitting material, a grounded support having a central hollow therein, the substrate-cover structure being located in said hollow and sealed hermetically at its edges to said support;

an electrical insulator located within said hollow and being hermetically sealed at its edges to said support, the insulator being spaced from said substrate and forming a hermetically sealed space therebetween, said space being evacuated; and an electrode for connection to a source of electrical potential, said electrode extending into said hermetically sealed space so that an electric field is produced between the electrode and the substrate upon application of an electrical potential difference between said electrode and said substrate;

said probe to be used with a set of reference fatigue samples of the same material as that being tested, each having a different but known amount of fatigue damage.

8. A positron-emitting probe designated as the "magnetic-field positron probe" for use in testing metal samples or objects for fatigue by positron lifetime techniques comprising:

a nonmagnetic substrate;

positron-emitting material supported by one side of said substrate;

a nonmagnetic thin window covering said positron-emitting material, said window being of such thinness and density as to not significantly impede the passage of positrons;

a support having a central hollow therein, the substrate-cover structure being located in said hollow and sealed hermetically at its edges to said support; and a magnet, one pole of which extends into said hollow and is spaced from said substrate, said magnet being hermetically sealed to said support wherein a space is formed within said hollow bounded by said magnet, said support and said substrate, said space being evacuated, said probe to be used with a set of reference fatigue samples of the same material as that being tested, each having a different but known amount of fatigue damage.

9. A positron-emitting probe designated as the "thin-scintillator positron probe" for use in testing metal samples or objects for fatigue by positron lifetime techniques comprising:

a gamma-ray-attenuating substrate;

positron-emitting material supported by one side of said substrate;

a thin sheet of scintillator material covering said positron-emitting material, said sheet extending beyond the substrate structure; and at least one photon detector located on the surface of said scintillator sheet, said probe to be used with a set of reference fatigue samples of the same material as that being tested, each having a different but known amount of fatigue damage.

* * * * *